US007396170B2

(12) United States Patent
Korthäuer

(10) Patent No.: US 7,396,170 B2
(45) Date of Patent: Jul. 8, 2008

(54) DEVICE FOR PRINTING ONE OR SEVERAL OBJECTS MOVING IN A FEED DIRECTION

(75) Inventor: Manfred Korthäuer, Mülheim/Ruhr (DE)

(73) Assignee: Espera-Werke GmbH, Duisburg (DE)

( * ) Notice: Subject to any disclaimer, the term of this patent is extended or adjusted under 35 U.S.C. 154(b) by 190 days.

(21) Appl. No.: 10/522,352

(22) PCT Filed: Aug. 30, 2003

(86) PCT No.: PCT/EP03/09641

§ 371 (c)(1),
(2), (4) Date: Jan. 26, 2005

(87) PCT Pub. No.: WO2004/033218

PCT Pub. Date: Apr. 22, 2004

(65) Prior Publication Data

US 2005/0232673 A1 Oct. 20, 2005

(30) Foreign Application Priority Data

Sep. 11, 2002 (DE) ..... 102 42 477

(51) Int. Cl.
*B41J 2/315* (2006.01)

(52) U.S. Cl. ..... 400/120.16; 400/120.05

(58) Field of Classification Search ..... 400/120.16, 400/124.05, 120.05
See application file for complete search history.

(56) References Cited

U.S. PATENT DOCUMENTS 4,277,186 A 7/1981 Takahashi ..... 400/188
4,422,376 A * 12/1983 Teraoka ..... 101/69
4,542,690 A * 9/1985 Kikuchi ..... 101/27
4,833,554 A * 5/1989 Dalziel et al. ..... 360/98.04
5,050,852 A * 9/1991 Sawada et al. ..... 271/11
5,366,302 A * 11/1994 Masumura et al. ..... 400/120.16
5,678,938 A * 10/1997 Saito et al. ..... 400/120.17
5,806,996 A * 9/1998 Leys et al. ..... 400/120.16
5,978,004 A * 11/1999 Ehrhardt ..... 347/171

(Continued)

FOREIGN PATENT DOCUMENTS

DE 2452393 5/1976

(Continued)

OTHER PUBLICATIONS

International Preliminary Examination Report.

*Primary Examiner*—Anthony H. Nguyen
(74) *Attorney, Agent, or Firm*—Collard & Roe, P.C.

(57) ABSTRACT

The invention relates to a device for printing one or several objects moving in a feed direction, in particular labels, packaging and packaging sections on a flat strip (1) or labels (2) stuck on a support band strip, comprising a print head (4) and means for introducing the object for printing to the print head. According to the invention, the supply speed of the material for printing and thus the printing capacity or labelling capacity of the device may be increased, without reducing the print quality and without increasing the wear on the print head (4) caused by the abrasive effect of the object, whereby the print head is provided with a drive (9, 11-16), by means of which the print head (4) may be moved in the feed direction of the object for printing and counter to the feed direction of the object.

10 Claims, 2 Drawing Sheets

U.S. PATENT DOCUMENTS

Figure 1:
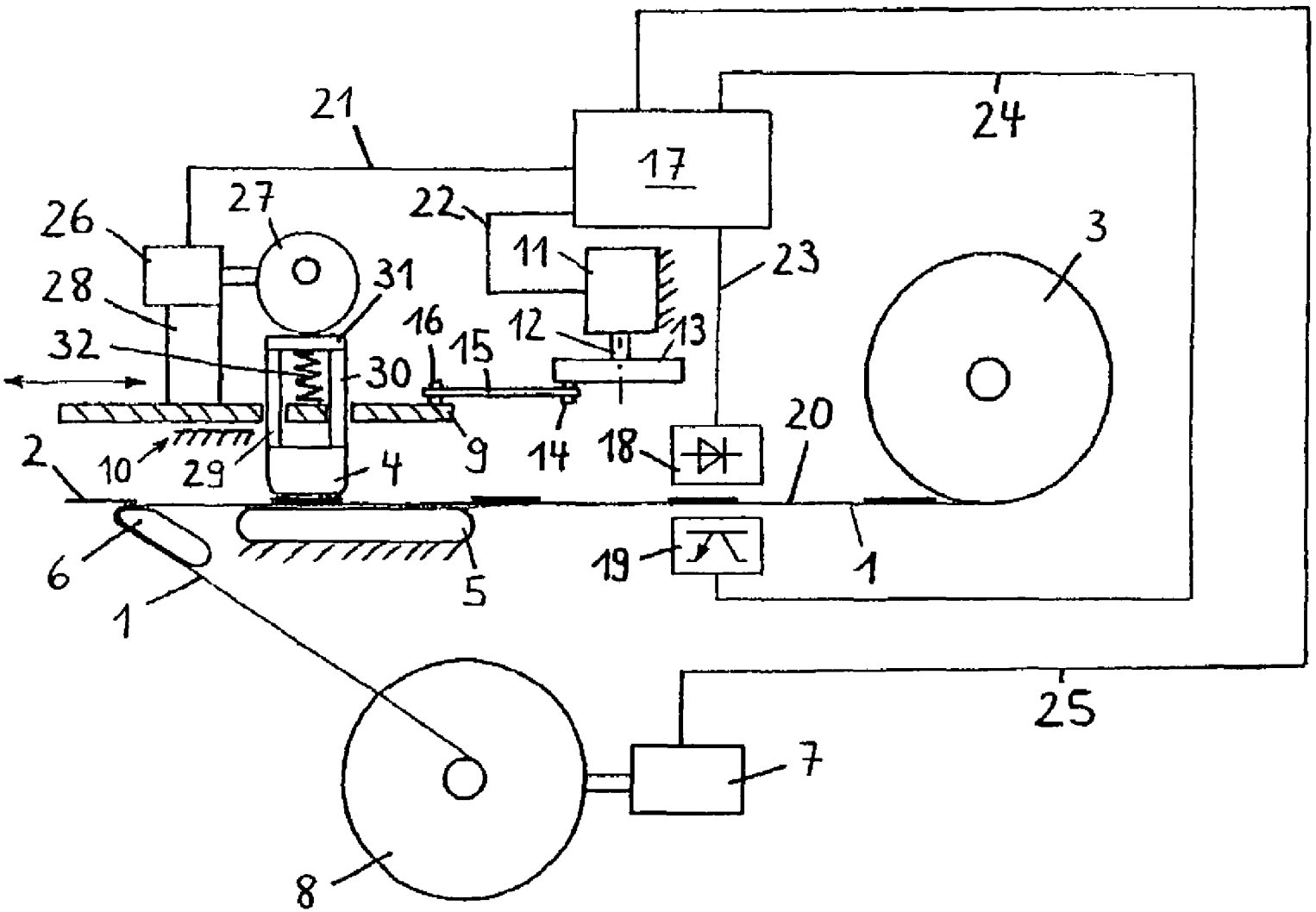

| | | | | |
|---|---|---|---|---|
| 6,099,176 | A * | 8/2000 | Miazga | 400/120.16 |
| 6,431,773 | B1 | 8/2002 | Plumley et al. | 400/120.16 |
| 2002/0135659 | A1 * | 9/2002 | Sato | 347/197 |

FOREIGN PATENT DOCUMENTS

| | | |
|---|---|---|
| DE | 3427306 | 2/1985 |
| DE | 4237275 | 5/1994 |
| DE | 19507892 | 9/1996 |

* cited by examiner

DEVICE FOR PRINTING ONE OR SEVERAL OBJECTS MOVING IN A FEED DIRECTION

CROSS REFERENCE TO RELATED APPLICATIONS

Applicant claims priority under 35 U.S.C. §119 of German Application No. 102 42 477.2 filed on Sep. 11, 2002. Applicant also claims priority under 35 U.S.C. §365 of PCT/EP2003/009641 filed on Aug. 30, 2003. The international application under PCT article 21(2) was not published in English.

The invention relates to a device for printing one or several objects moving in a feed direction, especially labels, packaging, packaging sections, a band strip or labels stuck on a support band strip, comprising a thermal print head and means for supplying the object to be printed to the thermal print head.

Such a device is known, for example, from DE 195 07 892 A1. In the known device a label tape, which consists of a carrier tape strip with labels adhering detachably thereto, is guided between a thermal print head and a pressure roller and printed using thermal printing or thermal transfer methods. The labels are then separated from the carrier tape using a separating device by guiding said carrier tape around a dispensing edge. The print head is fixed in a stationary position in the device and during printing using the thermal method, stays on the label or the carrier tape strip during the entire transport and printing time.

Furthermore, generic devices are known in which the print head is raised from the label and from the carrier tape strip for the times during which no printing takes place.

The printing speed of a thermal printer is limited with regard to the print quality. Furthermore, the wear of the thermal strip increases with increasing speed.

U.S. Pat. No. 6,431,773 B1 discloses a device for printing an object movable in a feed direction, comprising a print head and means for supplying the oblect to the print head. In the exemplary embodiments described the device is constructed as a plotter which has a print head. In this document a thermal print head is also mentioned as a possible design of the print head. The device comprises a frame which defines a work supporting surface and means for continuously transporting sheet-like work material to be printed in a first coordinate direction running in its longitudinal direction over the work supporting surface. An elongated support with a first and a second end is mounted to the frame and extends transversely over the work supporting surface. The print head is mounted to the support such that it is movable between its first and second ends. A control system in which graphical information is stored gives commands to the device to control the positional relationship of the print head relative to the support and the work material. During operation the combined movement of the print head and work material in accordance with commands issued by the control system causes the print head to print successive lineal portions of a graphic oriented approximately perpendicular to the first coordinate direction.

The object of the present invention is to improve a device of the type specified initially so that it offers a high printing capacity or labelling capacity without diminution of the print quality and/or increased wear of the thermal strip.

The thermal print head of the device according to the invention is provided with a drive by means of which the thermal printhead can be moved parallel to the feed direction of the object to be printed in its feed direction and counter to its feed direction. The drive is assigned a control system which controls it such that during movement parallel to the feed direction of the object the thermal print head has the same speed as the object being moved or a lower speed than the object being moved. Furthermore, the device according to the invention is characterised in that during movement counter to the feed direction of the object the thermal print head is moved at a distance from the object or labels adhering thereto. In this case, means for recording the supply speed of the object to be printed can preferably be provided, which means transmit measuring signals proportional to the supply speed to the control system, wherein the control system controls the movement of the print head depending on the recorded supply speed.

A further advantageous embodiment of the invention is characterised in that the drive by means of which the print head can be moved in the feed direction and counter to the feed direction of the band strip, has a slider-crank mechanism or a piezo-actuator. With a slider-crank mechanism, particularly fast forward- and backward-directed sliding movements of the print head parallel to the feed direction of the band strip can be achieved in a reliable fashion. The same applies to a piezo-actuator.

An advantageous further development of the device according to the invention consists in the fact that the stroke length of the slider-crank mechanism is adjustable. This arrangement makes it possible to adapt the forward- and backward-directed sliding movements of the print head parallel to the feed direction of the band strip depending on the label length and/or the spacing of the labels to be printed, which are stuck on the band strip.

A preferred embodiment of the device according to the invention further consists in the fact that the print head is attached to a support mounted in a sliding guide which support also carries the drive by means of which the print head can be moved onto the band strip and away from the band strip. This drive can in this case have a cam disk or a circular disk with eccentrically arranged axis of rotation by means of which the print head can be brought in contact with the band strip against the action of at least one spring element, preferably a helical spring.

Instead of a printing roller as it is present in conventional generic devices having a stationarily arranged print head, in the device according to the invention, a preferably plate-shaped counter-bearing can be arranged opposite to the print head, over which the back side of the band strip slides during its feed.

Further preferred and advantageous embodiments of the device according to the invention are specified in the dependent claims.

Figure 2:
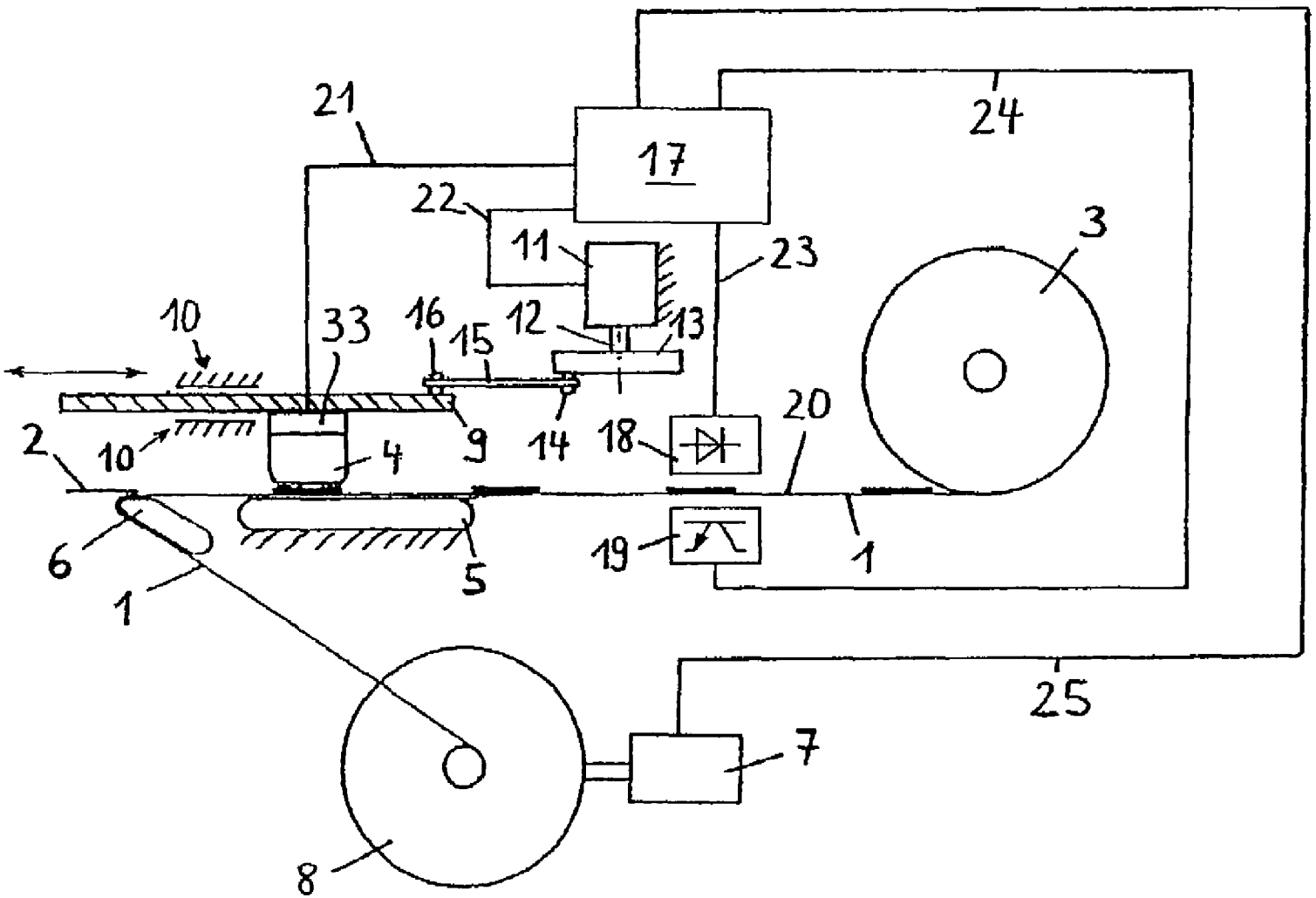

The invention is explained in detail subsequently with reference to drawings which show several exemplary embodiments. In the figures:

FIG. 1 is a schematic diagram of the device according to the invention according to a first exemplary embodiment, not to scale and FIG. 2 is a schematic diagram of the device according to the invention according to a second exemplary embodiment, not to scale.

FIG. 1 shows a device for printing labels 2 stuck on a support band strip 1. The labels 2 are attached to the support band strip 1 at substantially the same distance from one another. The band strip 1 is unwound from a supply roll 3 and fed to a printing mechanism. The printing mechanism consists of a print head 4 in the form of a thermal printing head and a plate-shaped counter-bearing 5 having a smooth surface over which the back side of the band strip 1 slides during its feeding. The print head 4 is constructed as strip-shaped and extends transverse to the feed direction of the band strip 1 substantially over its width or the width of the labels. The print head 4 presses the labels 2 with a sufficient force against the fixedly arranged plate-shaped counter-bearing 5 and prints them, for example, using the thermal printing or thermal transfer method. After the printing mechanism in the direction of travel of the strip there is provided a relatively sharp deflection in the form of a dispensing edge 6 at which the printed labels 2 can be detached in a per se known fashion from the support band strip 1 and removed through an opening in the housing of the device and can be applied to an object to be labelled. After the deflection at the dispensing edge 6, the support band strip 1 is wound onto a take-up roller 8 of a winding-on device driven by a stepping motor 7. The rotational speed of the stepping motor 7 or the take-up roller 8 is preferably continuously adjustable.

The thermal printing head 4 is held on a plate-shaped support 9 which is mounted in a sliding guide 10. The schematically represented sliding guide 10 can for example be formed from roller bearings. The support 9 is provided with a drive by means of which it and thus the print head 4 can be moved parallel to the feed direction and counter to the feed direction of the band strip 1. This is indicated by the double arrow. In the exemplary embodiment shown the drive comprises a stationarily arranged motor 11, preferably an electric motor whose motor shaft 12 drives a circular disk 13. The circular disk 13 has an eccentrically arranged pin 14 on which one end of a joint rod 15 is hinged. The other end of the joint rod 15 is hinged with a pin 16 attached to the support 9. The circular disk 13 with the eccentrically arranged pin 14, the joint rod 15 hinged thereon and the support 9 mounted in a sliding guide with the hinge pin 16' attached thereon thus form a slider-crank mechanism. The distance between the axis of rotation of the motor shaft 12 and the central point of the pivot pin 14 attached to the circular disk 13 determines the stroke length of the slider-crank mechanism.

In order to be able to displace the print head 4 if necessary with different stroke lengths in the feed direction and counter to the feed direction of the support band strip 1, the distance of the pivot pin 14 with reference to the axis of rotation of the motor shaft 12 is adjustable and the pivot pin 14 is accordingly displaceably and fixedly mounted on the circular disk 13.

The motor 11 of the drive has assigned to it a control system 17 which controls the drive such that during movement in the feed direction of the support band strip 1 the print head 4 has the same speed as the support band strip 1 or a lower speed than the support band strip 1. The reference numbers 18 and 19 denote a light-emitting transmitter diode and a receiving diode which reacts to light, which are part of a measuring device to record the supply speed of the support band strip 1. The labels 2 spaced substantially uniformly with respect to one another or other markings spaced substantially uniformly with respect to one another on the support band strip 1 interrupt the reception of the light emitted by the transmitter diode 18 at the receiving diode 19 if the band strip is constructed as transparent. If the receiving diode is to receive the light emitted by the transmitter diode as a result of light reflection on the labels 2 or on the label-free sections 20 of the support band strip 1, said receiving diode should be arranged, in contrast to the representation shown in the drawing, together with the transmitter diode 18 on the side of the support band strip 1 facing the labels 2.

Alternatively to the transmitter and receiving diodes 18, 19, other means can also be used to record the supply speed of the support band strip, e.g. a dynamo unrolling on the support band strip or the like.

The receiving diode 19 or the dynamo delivers measurement signals which are proportional to the supply speed of the support band strip 1. These signals are fed to the measuring and control device 17 which controls the rotational speed of the motor shaft 12 and thus the translatory movement of the support 9 and print head 4 depending on the recorded supply speed of the support band strip 1.

The support 9 is provided with a device by means of which the print head 4 can be moved onto the support band strip 1 and away from the support band strip 1. This device is also connected via a signal line 21 to the measuring and control device 17 and comprises an electric motor 26, preferably a stepping motor, and a circular disk 27 with an eccentrically arranged axis of rotation. A holder for the motor 26 constructed on the support 9 is designated by 28. The support 9 is shown in longitudinal cross-section in the drawing. The print head 4 is provided with rods 29, 30 running parallel to one another, which are guided in sliding bearings formed in the support 9. The upper ends of the rods 29, 30 are connected to one another by means of a transverse bar 31. Arranged between the support and the transverse bar is a spring element 32 in the form of a helical spring which moves the print head 4 away from the band strip. By means of the eccentrically mounted circular disk 27 which acts on the upper side of the transverse bar 31, the print head 4 can be brought in contact with the support band strip 1 or the respective label 2 to be printed against the action of the helical spring 32.

The measuring and control device 17 controls the drives in such a fashion that during movement in the feed direction of the support band strip 1, the print head 4 rests on a label 2 to be printed, which is stuck on the support band strip and during movement counter to the feed direction of the band strip 1, said print head is moved at a distance from the support band strip or the labels 2 adhering thereon.

The exemplary embodiment shown in FIG. 2 differs from the exemplary embodiment according to FIG. 1 merely in that instead of the electric motor 26, the eccentrically mounted circular disk 27, the holder 28, the parallel guide formed from the rods 29, 30 and the transverse bar 31 and the spring element 32, at least one piezo-actuator 33 is used in order to raise and lower the print head 4. In FIG. 2 the thermal print head 4 is affixed to at least one piezo-actuator 33 which for its part is held on the underside of the plate-shaped support 9. The support 9 is in turn mounted in a sliding guide 10. However, instead of the sliding guide 10, as already mentioned a roller bearing can also be used.

The invention is not restricted in its execution to the exemplary embodiments described herein before. Rather, several variants are feasible which also make use of the inventive idea, as disclosed in the claims, with a fundamentally different design. In particular, the invention is not restricted to the printing of labels stuck on a support band strip. Likewise, the invention can also be used to print continuous paper (so-called linerless) provided with an adhesive on one side, individually supplied labels without support paper and package envelopes to be partially printed, made of paper or cardboard.

LIST OF REFERENCE NUMBER

1 Support band strip
2 Label
3 Supply roll
4 Print head (thermal print head)
5 Counter-bearing
6 Dispensing edge
7 Stepping motor
8 Take-up roller

9 Support
10 Sliding guide
11 Motor
12 Motor shaft
13 Circular disk
14 Pivot pin
15 Joint rod
16 Pivot pin
17 Control system (measuring and control device)
18 Transmitter diode
19 Receiving diode
20 Label-free band section
21 Signal line
22 Signal line
23 Signal line
24 Signal line
25 Signal line
26 Electric motor
27 Circular disk
28 Holder
29 Rod
30 Rod
31 Tranverse bar
32 Spring element (helical spring)

The invention claimed is:

1. A device for printing at least one object moving at a supply speed in a feed direction comprising:

(a) a thermal print head;

(b) means for supplying the at least one object to be printed to the thermal print head;

(c) a first drive for moving the thermal print head parallel to or counter to the feed direction of the at least one object to be printed;

(d) a second drive for moving the thermal print head onto the at least one object to be printed and away from the at least one object; and (e) a control system for controlling the first drive and the second drive;

said first drive being controlled by the control system such that during movement of the thermal print head parallel to the feed direction of the at least one object the thermal print head has a speed less than or equal to the supply speed of the at least one object being moved; and said second drive being controlled by the control system such that during movement of the thermal print head counter to the feed direction of the at least one object the thermal print head is moved at a distance away from the at least one object.

2. The device according to claim 1, further comprising means for recording the supply speed of the object being moved, said means transmitting measuring signals proportional to the supply speed to the control system, the control system controlling the movement of the thermal print head depending on the recorded supply speed.

3. The device according to claim 1, wherein the first drive has a slider-crank mechanism.

4. The device according to claim 1, wherein the first drive has an adjustable stroke length in the feed direction and counter to the feed direction of the at least one object to be printed.

5. The device according to claim 1, wherein the, thermal print head is attached to a support mounted in a sliding guide, said support carrying the second drive.

6. The device according to claim 1, further comprising a cam disk for bringing the thermal print head in contact with the at least one object to be printed against the action of a spring element.

7. The device according to claim 5, wherein the second drive has at least one piezo-actuator.

8. The device according to claim 1, further comprising a plate-shaped counter-bearing opposite to the thermal print head, the back side of the at least one object to be printed sliding over said counter-bearing during feed of the at least one object.

9. The device according to claim 1, wherein the first drive has a piezo-actuator.

10. The device according to claim 1, further comprising a circular disk with an eccentrically arranged axis of rotation for bringing the thermal print head in contact with the at least one object to be printed against the action of a spring element.

* * * * *